United States Patent [19]

Kirjavainen

[11] 4,162,189

[45] Jul. 24, 1979

[54] PAPER MACHINE HAVING A HEADBOX PROVIDED WITH AN AIR TANK

[75] Inventor: Alvi Kirjavainen, Jyväskylä, Finland

[73] Assignee: Valmet Oy, Finland

[21] Appl. No.: 894,493

[22] Filed: Apr. 7, 1978

[30] Foreign Application Priority Data

Apr. 15, 1977 [FI] Finland ..... 771209

[51] Int. Cl.[2] ..... D21F 1/02

[52] U.S. Cl. ..... 162/337; 162/340; 162/343; 162/344; 162/347

[58] Field of Search ..... 162/337, 340, 343, 344, 162/347, 216

[56] References Cited

U.S. PATENT DOCUMENTS

| | | | |
|---|---|---|---|
| 2,993,538 | 7/1961 | Mustonen | 162/347 |
| 3,061,008 | 10/1962 | Walker | 162/344 X |
| 3,411,985 | 11/1968 | Means | 162/343 X |
| 3,563,852 | 2/1971 | Rojecki | 162/340 X |
| 3,976,539 | 8/1976 | Kirjavainen | 162/344 |
| 4,030,971 | 6/1977 | Justus | 162/340 X |
| 4,063,997 | 12/1977 | Kirjavainen et al. | 162/340 |

*Primary Examiner*—Richard V. Fisher

*Attorney, Agent, or Firm*—Steinberg & Blake

[57] ABSTRACT

A paper machine has a headbox provided with a slice through which a pulp suspension discharges from the headbox, this slice being defined in part by an upper lip frame. The pulp suspension flows to the slice from a distribution header and a turbulence passage assembly which receives the pulp stock from the distribution header and continues the flow thereof toward the slice. An air tank is provided for containing air under pressure to act on the flowing pulp stock so as to damp pressure fluctuations in the pulp suspension flow, and this air tank is connected in part to the upper lip frame of the slice so that the pressure in the air tank will act on the pulp suspension in the immediate vicinity of the slice.

12 Claims, 3 Drawing Figures

PAPER MACHINE HAVING A HEADBOX PROVIDED WITH AN AIR TANK

BACKGROUND OF THE INVENTION

The present invention relates to paper machines.

In particular, the present invention relates to the headbox of a paper machine, and especially to that type of headbox which is provided wth an air tank for containing air under pressure to equalize pressure fluctuations in the pulp suspension flow.

Thus with a construction of this type the volume of air which is under pressure in the air tank communicates with the pulp suspension flow, the pulp suspension discharging from the headbox through a slice thereof. The pulp suspension is received by a distribution header which delivers the pulp suspension to turbulence passages from which the pulp suspension flows to the slice.

Thus it is already known to use in connection with the headbox of a paper machine or at the approach pipe system of the headbox air tanks which communicate with the pulp suspension flow so that it is possible to attenuate pressure fluctuations and disturbances in the pulp suspension flow. However, up to the present time such air tanks have been situated well to the rear of the slice of the headbox so that the pulp suspension can flow through a considerable distance beyond the air tank before reaching the slice and thus can develop undesirable pressure fluctuations between the air tank and the slice. Although it is obviously desirable to situate the air tank as close as possible to the slice, it has always been necessary to situate the air tank at a location which is undesirably spaced from the slice because the construction of the headbox at the region of the slice thereof is such that an air tank cannot be accommodated directly at the region of the slice through which the pulp suspension discharges from the headbox.

SUMMARY OF THE INVENTION

It is accordingly a primary object of the present invention to provide a structure capable of egualizing pressure fluctuations of the pulp suspension in the headbox while at the same time being simpler than previously known constructions and acting in a more efficient manner with respect to the attenuation of pressure fluctuations or other disturbances in the pulp stock flow.

A more specific object of the present invention is to provide a construction according to which it becomes possible to situate an air tank in the immediate vicinity of the slice of the headbox so that any pressure fluctuations in the pulp stock suspension can be attenuated in the immediate region of the slice through which the pulp suspension discharges from the headbox.

According to the invention the slice means of the headbox includes an upper lip frame of a relatively light-weight construction, and the air tank is connected in part to this upper lip frame for acting on the pulp suspension in the immediate vicinity of the slice. Thus according to the present invention an air tank which in itself is known is mounted in direct association with the slice means of the headbox, extending above an upper lip frame of the slice means. It thus becomes possible to situate the air tank means at a location where it is capable of utilizing the pressure of the air therein to damp pressure perturbations at the closest possible vicinity of the pulp suspension discharge aperture, so that subsequent to the air tank it is not possible for new disturbances to be generated in the pulp suspension flow.

With the present invention use is made of a light-weight upper lip frame which is pivoted at its rear edge region to the headbox frame with this light-weight upper lip frame itself being capable of deflection. An elongated strip which forms the upper lip of the slice is situated directly in front of the upper lip frame but is capable of being adjusted independently of the upper lip frame by suitable fine adjustment spindles which are known, the construction being such that the deflections of the upper lip frame are not transmitted to the upper lip forming strip or to the structure for adjusting the same, this construction achieving an arrangement according to which there is no obstacle to situating the damping air tank at the location in the immediate region of the slice in accordance with the present invention.

Thus by way of the present invention it is possible to achieve a simple construction inasmuch as separate pressure equalizing means and various lifting means and shifting slides with the drives required thereby may be totally omitted.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
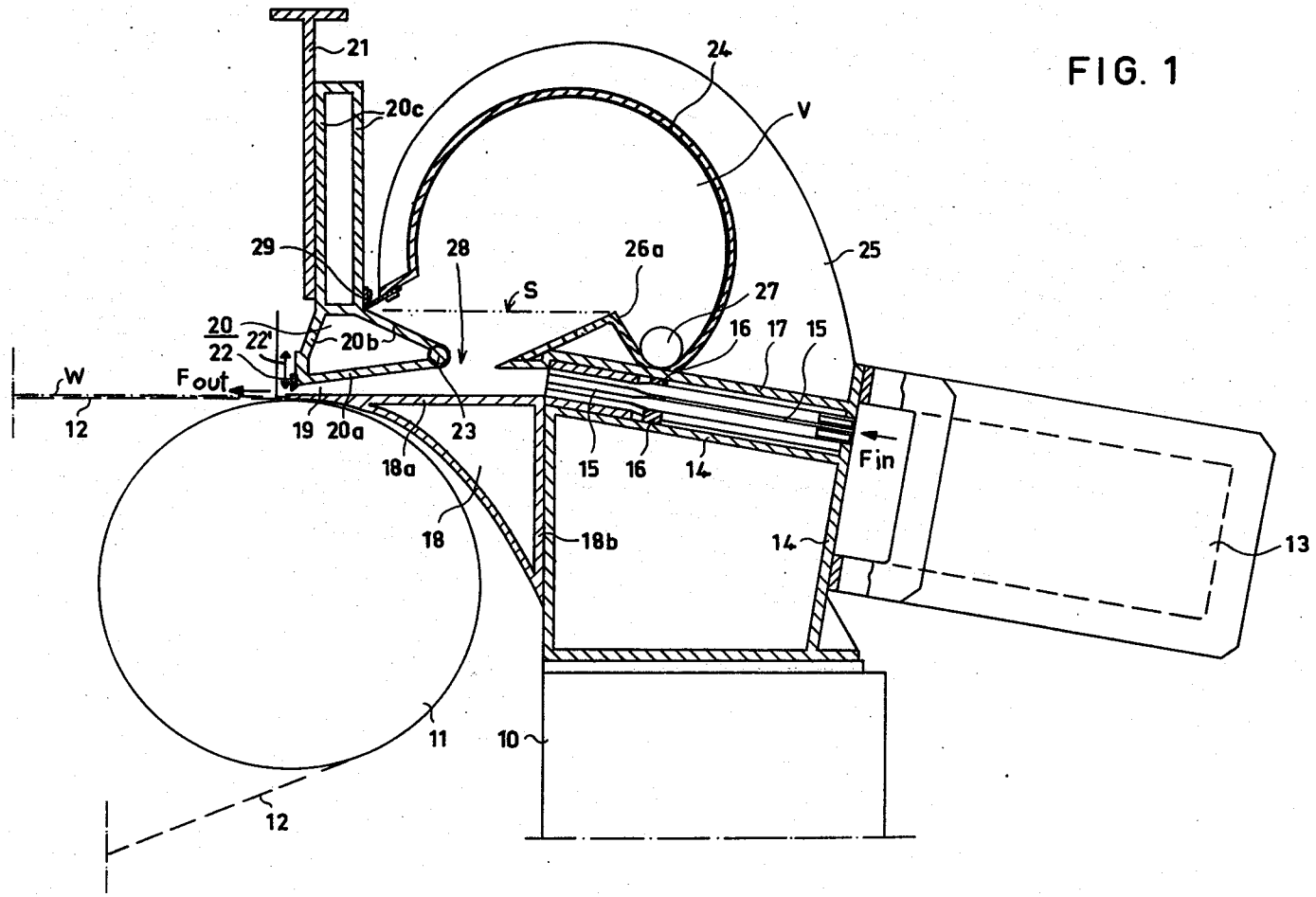
FIGS. 1–3 respectively illustrate in schematic longitudinal sectional side elevations three different possible embodiments of the invention.
Figure 2:
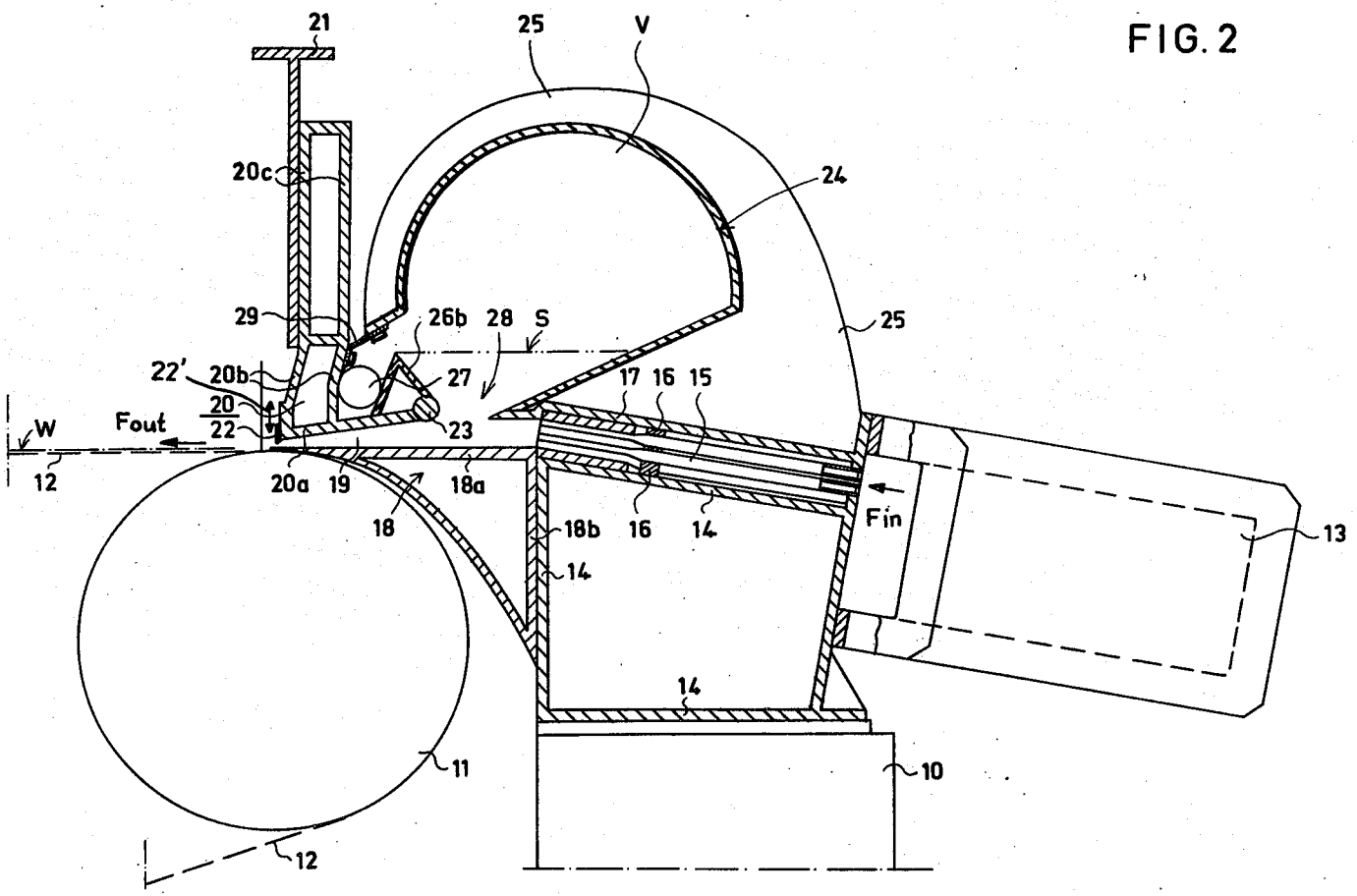
Figure 3:
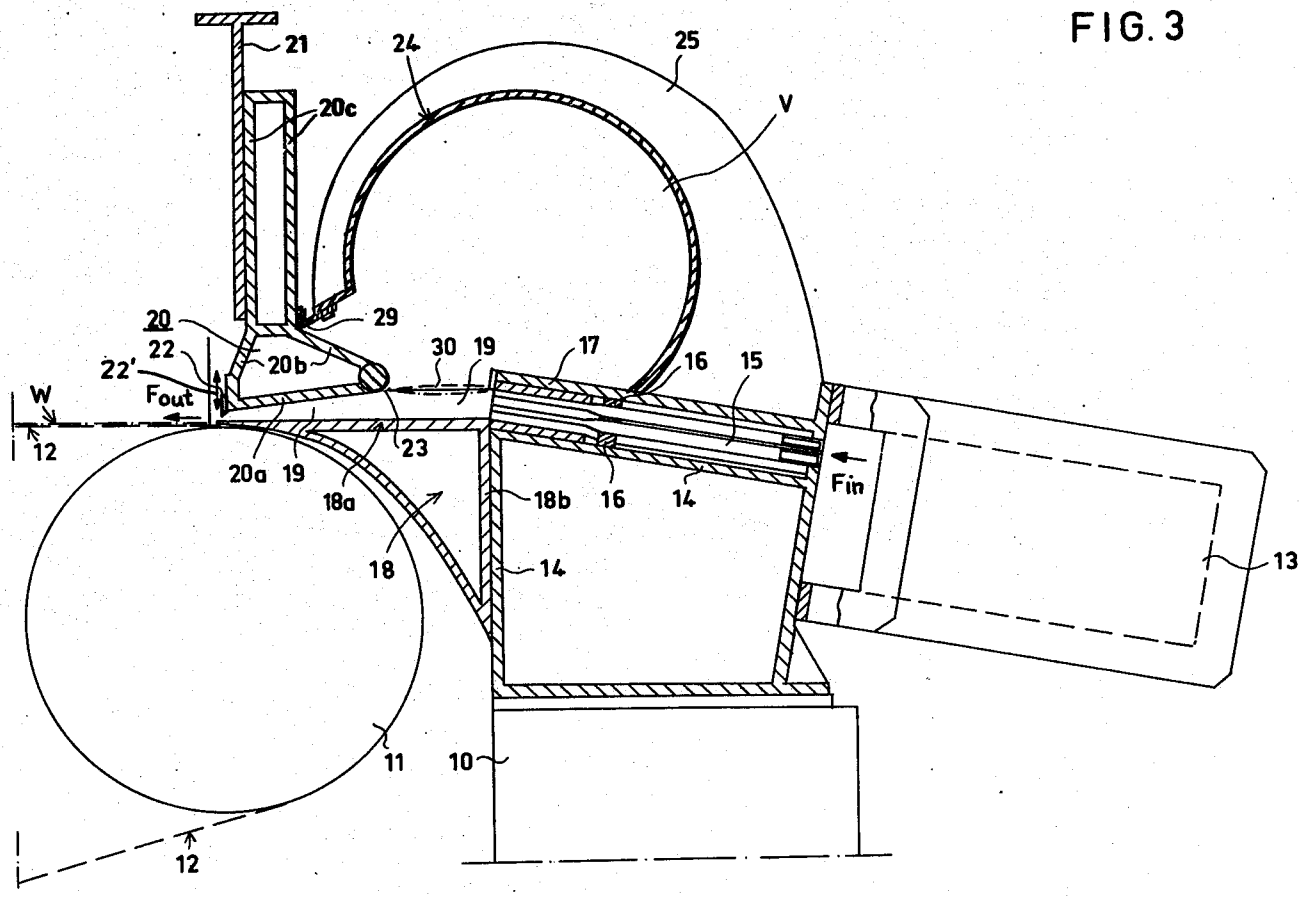

In the three different embodiments illustrated respectively in FIGS. 1–3, the paper machine headbox includes a base 10 on which there is mounted a frame beam 14 to which different components of the headbox are fixed. Thus the rear wal of the frame beam 14 has connected thereto a distribution header 13 of the headbox, this distribution header 13 being in itself known and providing for distribution of the pulp stock suspension flow which travels as indicated at $F_{in}$ from the distribution header means 13 through a turbulence section 15 of the headbox, this section 15 forming a turbulence passage means which in itself is known and includes a plurality of parallel flow passages each being of a relatively small cross section and each communicating at its rear end with the distribution header means 13 and at its front end with the upper surface of the wall **18*a* which forms a substantially horizontal apron board extending across the entire width of the machine and forming the lower limiting surface of the slice means. The slice means 19 is defined between the upper surface of the wall 18*a* and the lower surface of the wall 20*a* of a light-weight upper lip frame 20 of the headbox, the lower surface of the wall 20*a* and the upper surface of the wall 18*a* converging toward each other to define the slice through which the pulp suspension flows as indicated at $F_{out}$ onto the wire 12 which travels around the schematically illustrated breast roll 11, the web W forming on the wire 12 in a well known manner as shown schematically. The slice means 19 further includes a transversely extending strip 22 forming the upper lip of the slice means and situated directly in front of the upper lip frame 20 of the slice means. This strip 22 which forms the upper lip of the slice is capable of being independently adjusted by a separate adjusting means 22' indicated by the vertical double-headed arrow just in front of the strip 22. Thus the strip 22 can be adjusted independently of the upper lip frame 20, and for this purpose the means 22' includes in a known way a number of fine adjusting spindles carried by the structure 21 and operatively connected with the strip 22. Thus the several adjusting spindles for adjusting the strip 22 are distributed across the front of the vertical wall 21** in side by side relation transversely of the machine in the cross-machine direction.

The lip portion of the headbox includes the lower lip beam 18 whose upper wall **18*a* forms the apron board as referred to above, this lower lip beam 18 being hollow and of a substantially triangular cross section. The rear vertical wall 18*b* of the beam 18 is fixed directly to the front wall of the frame beam 14** of the headbox.

The hollow, light-weight upper lip frame 20 includes in addition to its lower wall **20*a*, the bottom surface of which determines the upper limit of the slice 19, upwardly extending walls 20*b* which extend upwardly from the front and rear edge regions of the lower wall 20*a*. This upper lip frame 20 has a rear edge region pivotally connected by a transverse pivot structure 23 to the frame of the headbox. Moreover, the upper lip frame 20 has the vertically extending portion 20*c* in front of which the fine adjusting spindles for the strip 22 are located. A construction of this latter type is shown, for example, in U.S. Pat. No. 3,976,539, which illustrates how it is possible to prevent deflections of the upper lip frame 20 from being transferred to the structure which carries the strip 22. It is thus possible when utilizing the present invention to provide an upper lip frame 20** which has a comparatively light-weight construction and relatively small dimensions.

According to the present invention an air-tank means 24 which in itself is of a known construction has been operatively connected with the slice means 19. The air-tank means 24 has an internal space V filled with air under pressure, this gas which is under pressure in the interior space V serving to damp in a known way those pressure disturbances which occur in the pulp suspension flow F. The air tank means 24 extends traversely across the entire width of the headbox and at its upper region has supporting flanges 25 which are respectively situated in the planes which extend longitudinally in the machine direction. The air-tank means 24 has a lower wall portion 17 which at its outer region at the bottom of the flanges 25 is fixed to the turbulence section 15 of the headbox, this lower wall portion 17 extending inwardly beyond the flanges 25 toward the left, as viewed in FIGS. 1–3, to terminate in FIGS. 1 and 2 somewhat beyond the left end of the turbulence passage means 15 while in FIG. 3 the lower wall portion 17 of the headbox terminates in a front edge which is approximately at the left end of the turbulence passage means 15. Of course at the inner edges of the flanges 25 the air-tank means 24 has a wall forming part of the cylinder, for example, and extending upwardly from the lower wall portion 17 rearwardly of the front edge thereof then around to terminate over the upper lip frame 20. The loads which are applied to the lower wall portion 17 of the air-tank means 24 are transmitted to the frame beam 14 through a supporting plate 16 which extends substantially vertically through the turbulence passage means 15, this supporting plate 16 being formed with perforations so that the pipe assembly which forms the turbulent section 15 passes through the supporting plate 16.

In the embodiments of FIGS. 1 and 2, it will be seen that the lower wall portion 17 of the air-tank means 24 terminates in a front edge which is spaced rearwardly from the rear end region of the upper lip frame 20, where the pivot 23 is located, so that this rear edge region of the upper lip frame 20 and the front edge of the lower wall 17 define between themselves an aperture or gap 28 which is of a substantially constant width and which extends transversely across the entire headbox. Through this aperture 28 it is possible for the pulp suspension flow to communicate with the space V in the interior of the air-tank means so that in this way the pulp suspension flow will be exposed to the influence of the air under pressure in the space V. In the embodiments of FIGS. 1 and 2 there is a direct contact between the air pressure in the air-tank means 24 and the pulp suspension, the latter extending upwardly through the aperture 28 and having an upper surface S of relatively large area in contact with the air under pressure in the space V. In FIGS. 1 and 2 the elevation of the surface S of the pulp suspension is determined by an overflow weir. Thus in FIG. 1 the overflow weir **26*a* includes a wall extending upwardly and rearwardly from the front edge of the lower wall portion 17 of the air-tank means 24, this upwardly and rearwardly inclined wall of the illustrated weir 26*a* being connected at its upper edge to a downwardly and rearwardly inclined wall which directs the pulp suspension which overflows the weir to an outlet pipe 27 forming an overflow pipe communicating with the interior of the tank 24 behind the weir 26*a* and directing the overflow back into circulation after the pulp suspension has travelled over the top edge of the weir 26*a*. It will be noted that in FIG. 1 a wall 20*b* of the upper lip frame 20 is inclined forwardly and upwardly from the rear edge of the upper lip frame where the pivot 23 is located, so that the upwardly and rearwardly inclined wall of the weir 26*a* and the upwardly and forwardly inclined wall 20*b* of the upper lip frame 20 converge in a downward direction toward the gap 28**.

In the embodiment of FIG. 2, the air-tank means 24 also has a wall which is inclined upwardly and rearwardly from the front edge of the lower wall 17, but in this case this upwardly and rearwardly inclined wall forms an extension of the cylindrical wall portion which extends around toward the front of the air-tank over the upper lip frame 20. In this case the upper lip frame 20 has its lower wall **20*a* extending rearwardly behind the rear vertically extending wall 20*b* and terminating in the pivot 23. In this case the overflow weir 26*b* includes a wall which extends upwardly and fowardly from the rear edge of the upper lip frame 20 where the pivot 23 is located, and the overflow is also directed to the pipe 27 which returns the overflowing pulp stock back into circulation. Thus the embodiment of FIG. 2 also has a weir 26*b* determining the elevation of the surface S, but in this case the weir is operatively connected with the lip frame 20*b*, and it will be seen that in FIG. 2 also the upwardly and forwardly inclined wall of the weir 26*b* and the upwardly and rearwardly inclined wall extending from the front edge of the lower wall portion 17 of the tank 24 converge downwardly toward the gap 28**.

In the embodiment of FIG. 3 there is no direct communication between the pulp suspension and the air under pressure in the air-tank means 24. Instead with this embodiment there is a deflectable wall means 30 which has an upper surface contacting the air under pressure in the air-tank means 24 and a lower surface contacting the pulp suspension so that it is through the deflectable wall means 30 that the air under pressure acts on the pulp suspension in the slice means 19. In the particular example illustrated in FIG. 3, the deflectable wall means 30 is in the form of a stretchable resilient diaphragm made, for example, of rubber, this diaphragm 30 extending across the entire width of the headbox and being fluid-tightly fixed along its entire periphery to the opposed sides of the headbox as well as at its rear edge to the front end or edge of the lower wall portion 17 of the air-tank while at its front edge the diaphragm 30 is fixed in a fluid-tight manner to the rear edge of the upper lip frame 20. Thus through this deflectable wall means 30 it is possible to achieve the vibration-damping communication between the pulp suspension and the air under pressure.

Instead of using at the space between the rear edge of the upper lip frame 20 and the front edge of the lower wall portion 17 a resilient stretchable disphragm 30, it is also possible to use a hinged plate or other equivalent pressure-transmission members as shown, for example, in U.S. patent applications Ser. Nos. 839,502 and 839,503.

As has been indicated above, the upper lip frame 20 is of a comparatively light-weight construction and is permitted to undergo deflections in a comparatively free manner. Since furthermore the surface area dimensions of the pressure loads acting on the upper lip frame 20, both horizontally and vertically, are relatively minor, the loads imposed by the pressure of the pulp stock on the upper lip frame 20 can be made relatively minor. The deflections caused by such loads are not permitted to extend up to the edge strip 22, so that in this way a comparatively simple construction is achieved.

As is illustrated in FIG. 1–3, the lower front edges of the flanges 25 are fixed to a transversely extending front wall of the air-tank means 24, and this transversely extending front lower wall of the air-tank means 24, is fixed in a fluid-tight manner to a transversely extending rear edge region of a resilient stretchable strip 29 of rubber or the like, the front edge region of this strip 29 being fluid-tightly fixed to the upper lip frame 20, while the opposed side edge regions of the strip 29 are fluid-tightly fixed to the opposed side walls of the air-tank means 24 and the opposed ends of the upper lip frame 20, so that in this way the connection between the air-tank means 24 and the upper lip frame 20 is such that this upper lip frame is relatively free to find its own particular position with respect to the air-tank means 24.

Of course the invention is not to be narrowly confined to the details presented above by way of example only and which may vary within the frame of the inventive concept defined by the claims which follow.

What is claimed is:

1. In a paper machine, a headbox comprising slice means through which a pulp suspension discharges from the headbox, distribution header means for receiving the pulp suspension and distributing the same, turbulence passage means comprising a turbulence passage member having a plurality of parallel flow passages each being of relatively small cross section, the downstream ends of said passages communicating with said distribution header means and the upstream ends of said passages terminating in the vicinity of said slice means so that the pulp suspension is received from said distribution header means and travels through said parallel flow passages along a path of flow from the distribution header means toward said slice means, and air-tank means for containing air under pressure which acts on the flowing pulp suspension in the space defined between the upstream ends of said parallel flow passages and said slice means as the pulp suspension travels toward said slice means for attenuating pressure fluctuations and disturbances in the pulp suspension, said air-tank means being operatively connected with said slice means immediately adjacent thereto for acting on the pulp suspension flow in the immediate vicinity of said slice means.

2. The combination of claim 1 and wherein said slice means includes an upper lip frame of light-weight construction having a rear pivotally mounted portion and said air-tank means being operatively connected in part to said upper lip frame of said slice means.

3. The combination of claim 2 and wherein said slice means includes at a front surface of said upper lip frame an elonated strip forming an upper lip of said slice means and adjusting means operatively connected to said strip for adjusting the same independently of said upper lip frame, the latter being free to be deflected without disturbing the adjustment of said strip.

4. The combination of claim 1 and wherein said slice means includes an upper lip frame to which said air-tank means is operatively connected in part, and means situated just behind said upper lip frame for transmitting the pressure of air in said air-tank means to the pulp suspension which flows to said slice means.

5. The combination of claim 4 and wherein said means just behind said upper lip frame includes a lower wall portion of said air-tank means which is situated behind and spaced from said upper lip frame while defining therewith an aperture through which the pulp suspension communicates with the interior of said air-tank means.

6. The combination of claim 5 and wherein said lower wall portion of said air-tank means terminates in a front edge, and said air-tank means having a wall portion inclined upwardly and rearwardly from said front edge of said lower wall portion thereof, said upper lip frame terminating in a rear edge which is spaced forwardly from said front edge of said lower wall portion of said tank means and said upper lip frame having an upper wall portion inclined forwardly and upwardly from said rear edge thereof, so that said upwardly and forwardly inclined wall portion of said lip frame means and said upwardly and rearwardly inclined wall portion of said air-tank means converge downwardly toward said aperture, and one of said inclined wall portions terminating in an upper edge over which the pulp stock can flow so that said one inclined wall portion forms a weir determining the elevation of an upper surface of the pulp stock suspension on which the air pressure in said air-tank means acts.

7. The combination of claim 6 and wherein said inclined wall portion which forms said weir is said upwardly and rearwardly inclined wall portion of said air-tank means.

8. The combination of claim 7 and wherein said turbulence passage means extends beneath said upwardly and rearwardly inclined wall portion of said air-tank means which forms said weir.

9. The combination of claim 6 and wherein said upwardly and forwardly inclined wall portion of said upper lip frame forms said weir.

10. The combination of claim 4 and wherein said means situated behind said upper lip frame includes a lower wall portion of said air-tank means which terminates in a front edge spaced from and situated behind said upper lip frame, and deflectable wall means extending from said front edge of said lower wall portion of said air-tank means up to a rear edge region of said upper lip frame for transmitting pressure in said air-tank means to pulp stock suspension which flows to said slice means beneath said deflectable wall means.

11. The combination of claim 10 and wherein said deflectable wall means is in the form of a stretchable resilient rubber diaphragm connected between the rear edge region of said upper lip frame and said front edge of said lower wall portion of said air-tank means.

12. The combination of claim 1 and wherein said slice means includes an upper lip frame while said air-tank means terminates in a front region situated over said upper lip frame and includes an elongated resilient strip means interconnecting said front region of said air-tank means with said lip frame.

* * * * *